US006259009B1

(12) United States Patent
Bolo, III

(10) Patent No.: US 6,259,009 B1
(45) **Date of Patent: *Jul. 10, 2001**

(54) STRAP LOCKING AND PICK STORAGE DEVICE

(75) Inventor: Robert T. Bolo, III, New York, NY (US)

(73) Assignee: BoloPick, New York, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/625,708

(22) Filed: Jul. 25, 2000

Related U.S. Application Data

(63) Continuation-in-part of application No. 09/363,587, filed on Jul. 29, 1999, now Pat. No. 6,169,238.

(51) Int. Cl.[7] ..... G10D 3/00

(52) U.S. Cl. ..... 84/329; 84/322; 84/453; 84/320

(58) Field of Search ..... 84/453, 320, 321, 84/322, 329, 458; 24/545, 567, 664

(56) References Cited

U.S. PATENT DOCUMENTS

| | | | | |
|---|---|---|---|---|
| D. 309,674 | | 8/1990 | Gervase | D3/30.1 |
| D. 355,667 | | 2/1995 | Burger | D17/20 |
| D. 362,264 | | 9/1995 | Trees | D17/20 |
| D. 393,362 | | 4/1998 | Byers | D3/204 |
| 1,020,961 | * | 3/1912 | Butcher, Jr. | 24/545 |
| 2,548,254 | * | 4/1951 | Churchill, Jr. | 24/567 |
| 3,688,012 | | 8/1972 | Vettel | 84/327 |
| 3,894,464 | | 7/1975 | Brooks | 84/327 |
| 4,014,240 | | 3/1977 | Pullen | 84/327 |
| 4,028,981 | | 6/1977 | Cravens | 84/327 |
| 4,067,255 | | 1/1978 | Camaioni | 84/322 |
| 4,135,431 | | 1/1979 | Ferguson | 84/329 |
| 4,144,794 | | 3/1979 | Silverman et al. | 84/327 |
| 4,188,851 | | 2/1980 | Wolf | 84/327 |
| 4,271,999 | | 6/1981 | Stravitz | 224/257 |
| 4,274,181 | | 6/1981 | Schaller | 24/201 A |
| 4,291,822 | | 9/1981 | Simonds | 224/257 |
| 4,357,063 | | 11/1982 | Gray | 339/75 P |
| 4,370,040 | | 1/1983 | Lange | 354/288 |
| 4,569,105 | * | 2/1986 | Weider | 482/107 |
| 4,592,266 | | 6/1986 | Daugherty | 84/327 |
| 4,779,778 | | 10/1988 | Nixon, II | 224/269 |
| 4,785,708 | | 11/1988 | Vaughan | 84/329 |
| 4,843,943 | | 7/1989 | Hoshino | 84/327 |
| 4,901,900 | | 2/1990 | Goto | 224/257 |
| 4,993,127 | | 2/1991 | Mechem et al. | 24/701 |

(List continued on next page.)

*Primary Examiner*—Shih-Yung Hsieh

(57) ABSTRACT

A combination strap lock and pick storage device includes a pair of arms each having a free end and an opposite end forming a ring defining a passage therethrough. The arms may be forced toward each other to expand the cross-sectional area of the passage sufficiently to allow passage therethrough of an enlarged head of a peg attached to a musical instrument. The arms may then be released so that the passage resumes its original cross-sectional area and engages a shaft portion of the peg. The device thus secures a support strap, previously mounted to the peg, to the musical instrument. Each arm additionally defines a channel along an inside surface thereof, wherein the opposing channels are configured to receive a flat pick therein. The device is configured such that one or more picks may be easily advanced into, or retrieved from, the channels defined in each of the arms. The arms may further define lobes adjacent to the channels for guiding picks within, and from, the channels. In an alternate embodiment, the ring is replaced with a washer structure for incorporating the resultant pick holding device into an existing strap locking device. In either case, a musical instrument strap may include any number of attachment structures configured for engaging and supporting separate ones of the devices to thereby provide for a supply of picks within easy reach of the musician.

27 Claims, 10 Drawing Sheets

U.S. PATENT DOCUMENTS

| | | | |
|---|---|---|---|
| 5,299,485 | 4/1994 | Denton | 84/329 |
| 5,413,020 | 5/1995 | Thompson | 84/329 |
| 5,488,892 | 2/1996 | Jepsen | 84/322 |
| 5,651,468 | 7/1997 | Irizarry | 211/120 |
| 5,739,445 | 4/1998 | Terry et al. | 84/329 |
| 5,796,021 | 8/1998 | Longshore | 84/329 |
| 5,847,299 | 12/1998 | Zovko, Jr. et al. | 84/329 |
| 5,905,217 | 5/1999 | Byers | 84/322 |

* cited by examiner

STRAP LOCKING AND PICK STORAGE DEVICE

CROSS-REFERENCE TO RELATED U.S. PATENT APPLICATION

This is a continuation-in-part U.S. patent application Ser. No. 09/363,587 entitled COMBINATION STRAP LOCK AND PICK STORAGE DEVICE, filed Jul. 29, 1999, now U.S. Pat. No. 6,169,238.

FIELD OF THE INVENTION

The present invention relates generally to accessories for musical instruments, and more specifically to such accessories operable to maintain connection of a support strap to a musical instrument and/or to provide a structure for storing one or more musical instrument picks.

BACKGROUND OF THE INVENTION

Heretofore, musicians and musical instrument designers have adapted their instruments and devised various devices to enable the instruments to be played in a variety of different positions. For example, many stringed instruments such as guitars, mandolins, banjos and the like include one or more pegs affixed thereto for engaging a support strap, whereby the instrument may be suspended by the strap from the musician's body to enable mobile playing thereof.

Typically, the one or more pegs affixed to the stringed instrument include an enlarged head portion having a reduced diameter shaft or shank extending therefrom wherein the free end of the shaft is affixed to the instrument by various known means. Conventional support straps define an aperture therethrough adjacent at least one end thereof, wherein the aperture typically includes a slit extending therefrom. The aperture of the strap is forced over the head of a corresponding peg and onto the shaft to thereby connect the support strap to the instrument. In this process, the slit is generally operable to separate as the aperture is forced over the head, thereby effectively enlarging the aperture opening sufficiently to allow passage of the enlarged head therethrough.

The regions of the support strap defining the above-described aperture/slit configuration are typically formed of a semi-flexible material such as leather, vinyl or the like. Such materials are known to stretch and/or deform through repeated engagement and disengagement with the instrument peg, and support strap apertures thus tend to become enlarged and the slits overly flexible through normal use. Accordingly, there exists an ever-increasing possibility that the strap aperture may slip over the enlarged head of the peg, thereby disengaging the instrument from its wearer. Potential damage to, or destruction of, the instrument could result.

The foregoing problem associated with the above-described instrument/strap attachment structures has been addressed heretofore, and a number of strap locking and/or latching devices have been devised to ensure secure attachment of the support strap to the instrument. One approach to such a strap locking device includes modifying the instrument peg to include a strap locking feature. Examples of such devices are disclosed in U.S. Pat. Nos. 3,894,464, 4,014,240, 4,028,981, 4,144,794, 4,274,181, 4,291,822, 4,592,266, 4,843,943 and 4,901,900. While such devices are generally operable to provide adequate strap locking capabilities, they have certain drawbacks associated therewith. For example, the disclosed strap locking devices are designed to replace existing instrument pegs, and the mounting of such structures typically requires modifications to the instrument itself. Many musicians, particularly those who own and routinely play vintage or collectable instruments, desire to maintain the originality of their instruments and therefore will not use such devices. Moreover, many of these peg replacement devices are complicated and cumbersome to use.

Another known approach to strap locking devices includes modifying the strap to include a strap locking feature. Examples of such devices are disclosed in U.S. Pat. Nos. 3,688,012, 4,188,851, 4,271,999, 4,370,040 and 4,993,127. While such devices are generally operable to provide adequate strap locking capabilities, they have certain drawbacks associated therewith. For example, such devices are typically complicated and expensive to manufacture. Moreover, many musicians prefer to use customized straps that may not include, and may not be modifiable to include, such strap locking features.

Yet another known approach to strap locking devices includes providing a locking structure that is independent of both the strap and the instrument peg. An example of one such device is disclosed in U.S. Pat. No. 4,357,063 and includes a pair of juxtaposed disk-like structures each defining an aperture therethrough. The disks are rotatably connected such that the two apertures align in one position to allow passage therethrough of the enlarged head of the instrument pin. With the device apertures positioned about the reduced diameter shaft of the pin, one disk is rotated relative to the other such that the two apertures align in a second position having a diameter that is smaller than the head of the instrument pin. While this device overcomes some of the drawbacks of the above-described strap locking devices by providing a strap locking structure that is independent of both the support strap and the instrument pin, it has its own drawbacks associated therewith. For example, the dual-disk structure is complicated in its manufacture and assembly, and is further cumbersome and difficult to operate.

Another problem associated with the mobile playing of an instrument, and particularly of a stringed instrument, is the ready availability to the musician of needed musical accessories. For example, many guitar and mandolin players use flat picks, which may easily slip from the player's grasp when strumming or picking the strings. For this reason, designers of stringed instrument accessories have designed various structures for storing picks within ready access of the musician. One particular type of known pick storage structure includes a pick housing or holding structure that is affixable to the surface of the instrument and is configured to hold a number of picks. Examples of this type of pick storage structure are disclosed in U.S. Pat. Nos. 4,135,431, 4,785,708, 5,488,892, 5,796,021 and 5,847,299. While such pick holding structures are typically effective at accomplishing their intended purpose, such structures are generally undesirable from a musician's perspective because they involve either modifying the instrument body or affixing a structure to the instrument body in such a manner that may adversely affect the instrument tone/sound or that may damage the instrument finish.

Another known type of pick storage structure includes a pick housing or holding structure that may be affixed or attached to an instrument support strap or to the musician. Examples of such pick storage structures are disclosed in U.S. Pat. Nos. 4,779,778, 5,299,485, 5,413,020, 5,739,445, Des. 309,674 and Des. 362,264. Such pick storage structures are generally undesirable as cumbersome and/or as requiring modifications to the support strap or other structure.

Yet another known type of pick storage structure includes a housing or holding structure that may be detachably affixed to a portion of the instrument or to one of the instrument accessories. Examples of such pick storage structures are disclosed in U.S. Pat. Nos. 4,067,255, 5,651,468, Des. 393,362 and Des. 355,667. Most of these pick storage structures present a drawback in that the picks are located remote from the musician and are therefore difficult to store/retrieve. U.S. Pat. No. Des. 393,362, on the other hand, discloses a pick storage pouch that includes an aperture suitable for connection to an instrument strap pin. However, the position of the pouch does not appear to be adjustable relative to the strap pin, and the configuration of the pick storage area is such that storage and retrieval of a pick is difficult and cumbersome.

What is therefore needed is a combination instrument strap locking and pick storage device that overcomes the drawbacks associated with the above-described devices. Such a combination strap locking and pick storage device should ideally be simple in its design, manufacture and use, and should further be independent of the instrument, support strap and musician.

SUMMARY OF THE INVENTION

The foregoing shortcomings of the prior art are addressed by the present invention. In accordance with one aspect of the present invention, a pick storage device comprises a first arm defining a free end and an opposite end, a second arm defining a free end and an opposite end, and a ring connecting the opposite end of the first arm to the opposite end of the second arm, wherein the first and second arms define opposing channels therein extending from the free ends thereof toward the ring. The channels are sized for receiving opposite edges of a plurality of musical instrument picks therein for storage between the first and second arms.

In accordance with another aspect of the present invention, a pick storage device comprises a first arm defining a free end, an opposite end and a first inner arm surface therebetween defining therein a first channel extending from the free end toward the opposite end thereof, a second arm defining a free end, an opposite end and a second inner arm surface therebetween defining therein a second channel extending from the free end toward the opposite end thereof, and means for connecting the opposite end of the first arm to the opposite end of the second arm. At least a portion of the first inner arm surface defines a first lobe adjacent to the free end of the first arm and extending inwardly toward the second inner arm surface, and at least a portion of the second inner arm surface defines a second lobe adjacent to the free end of the second arm and extending inwardly toward the first inner arm surface.

In accordance with yet another aspect of the present invention, a pick storage device comprises a first arm having a free end, an opposite end and a first inner arm surface therebetween, a second arm having a free end, an opposite end and a second inner arm surface therebetween, wherein the first and second arms are configured to store at least one musical instrument pick therebetween, and a washer member connecting the opposite end of the first arm to the opposite end of the second arm with the first inner arm surface facing the second inner arm surface, and wherein the washer member defines a first opening therethrough.

In accordance with yet another aspect of the present invention, a pick storage device comprises a first arm defining a free end and an opposite end, a second arm defining a free end and an opposite end, means for connecting the opposite end of the first arm to the opposite end of the second arm, the first and second arms defining therein opposing channels sized for receiving therein opposite edges of at least one musical instrument pick for storage between the first and second arms, and a musical instrument strap defining at least one device attachment structure along a portion of the musical instrument strap between first and second ends thereof, the at least one device attachment structure engaging the connecting means and supporting the pick storage device.

One object of the present invention is to provide a strap lock device for a musical instrument, and for a stringed musical instrument in particular.

Another object of the present invention is to provide a pick storage device attachable to a support strap peg of a stringed musical instrument.

Yet another object of the present invention is to provide a combination strap lock and pick storage device for a musical instrument, and for a stringed musical instrument in particular.

Still another object of the present invention is to provide such a combination strap lock and pick storage device for a stringed musical instrument that is attachable to a support strap peg of the instrument to thereby secure the support strap to the support strap peg while also providing a storage location for an auxiliary flat pick.

A further object of the present invention is to provide a combination strap lock and pick storage device operable to store a number of musical instrument picks therein.

Yet a further object of the present invention is to provide a pick storage device securable to an existing musical instrument strap locking device.

These and other objects of the present invention will become more apparent from the following description of the preferred embodiments.

DESCRIPTION OF THE PREFERRED EMBODIMENTS

Figure 1:
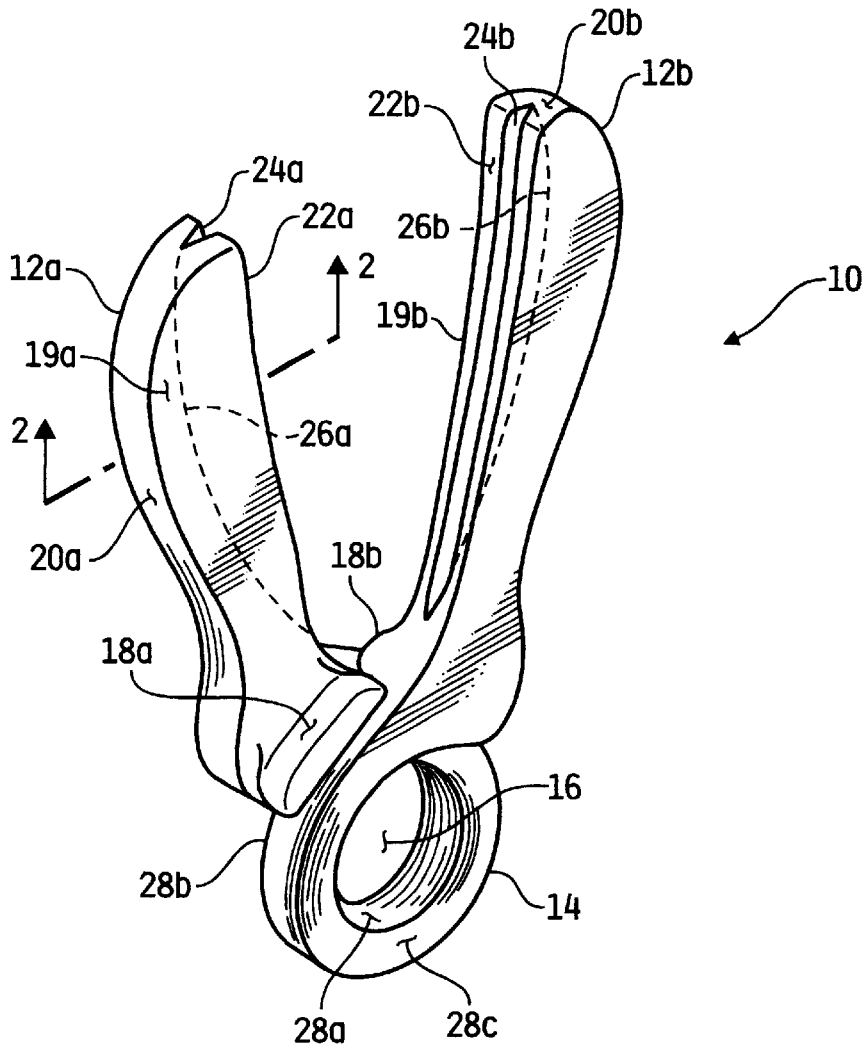
FIG. 1 is a front perspective view of one preferred embodiment of a combination strap lock and pick storage device, in accordance with the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated devices, and such further applications of the principles of the invention as illustrated therein being contemplated as would normally occur to one skilled in the art to which the invention relates.

Figure 2:
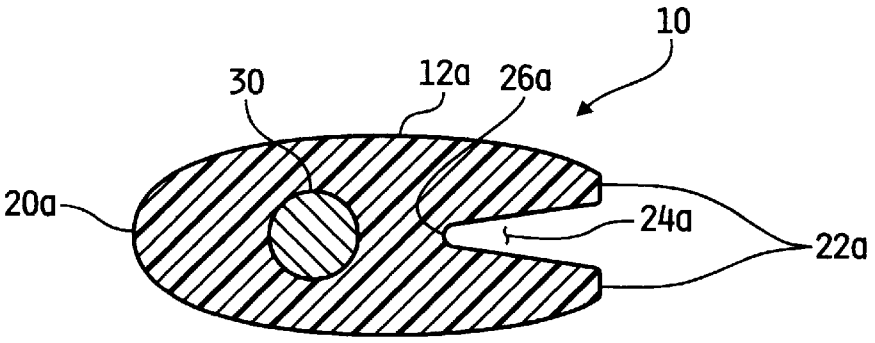
FIG. 2 is a cross-sectional view of the device illustrated in FIG. 1 as viewed along section lines 2—2.

Referring now to FIGS. 1 and 2, one preferred embodiment of a combination strap lock and pick storage device 10, in accordance with the present invention, is shown. Device 10 includes a first arm 12*a* and a second arm 12*b*, each having a free end and an opposite end forming a single ring 14 defining a passage 16 therethrough. In one embodiment, the ring 14 is preferably annular in shape and forms a substantially circular passage 16 therethrough, although the present invention contemplates that the ring 14 may be any desired shape forming a passage 16 therethrough having any desired configuration as will be described in greater detail hereinafter. Ring 14 defines an inside face 28*a* which itself defines the configuration of passage 16, a rear surface 28*b* and an opposite front surface 28*c*.

Each arm 12*a* and 12*b* further includes a corresponding protrusion 18*a* and 18*b* extending from corresponding front and rear faces 19*a* and 19*b* thereof adjacent to the ring 14. In one preferred embodiment, protrusions 18*a* and 18*b* are positioned in slidable contact with an outer surface of the ring 14, although the present invention contemplates other configurations of protrusions 18*a* and 18*b*, wherein the purpose of any such protrusions 18*a* and 18*b* will be described in detail hereinafter.

Arm 12*a* of device 10 defines an outside face 20*a* and an opposite inside face 22*a*, and harm 12*b* similarly defines an outside face 20*b* and an opposite inside face 22*b*. Faces 22*a* and 22*b* each define a channel therein 24*a* and 24*b* respectively. In one preferred embodiment, channels 24*a* and 24*b* are identically configured, and each extend into faces 22*a* and 22*b* respectively to define arcuate-shaped channel surfaces 26*a* and 26*b* respectively as most clearly shown in FIG. 1, although the present invention contemplates other configurations of channel surfaces 26*a* and 26*b* as will be described in greater detail hereinafter.

In one embodiment, the combination strap lock and pick storage device 10 of the present invention is composed of a formable medium disposed about a steel or other metallic wire 30 as most clearly shown in FIG. 2. In one embodiment, device is formed of a plastic material, although the present invention contemplates constructing device 10 from other moldable materials such any of a variety of plastic resin materials, nylon, epoxy, or the like. Wire 30 is preferably included to provide device 10 with greater strength and further to bias arms 12*a* and 12*b* away from each other in a position similar to that shown in FIG. 1, although the present invention contemplates substituting other stiffening and biasing materials for wire 30. Alternatively still, the present invention contemplates omitting wire 30 altogether and constructing device 10 of a formable medium having sufficient strength and resilience to bias arms 12*a* and 12*b* away from each other in a position similar to that shown in FIG. 1.

Figure 3:
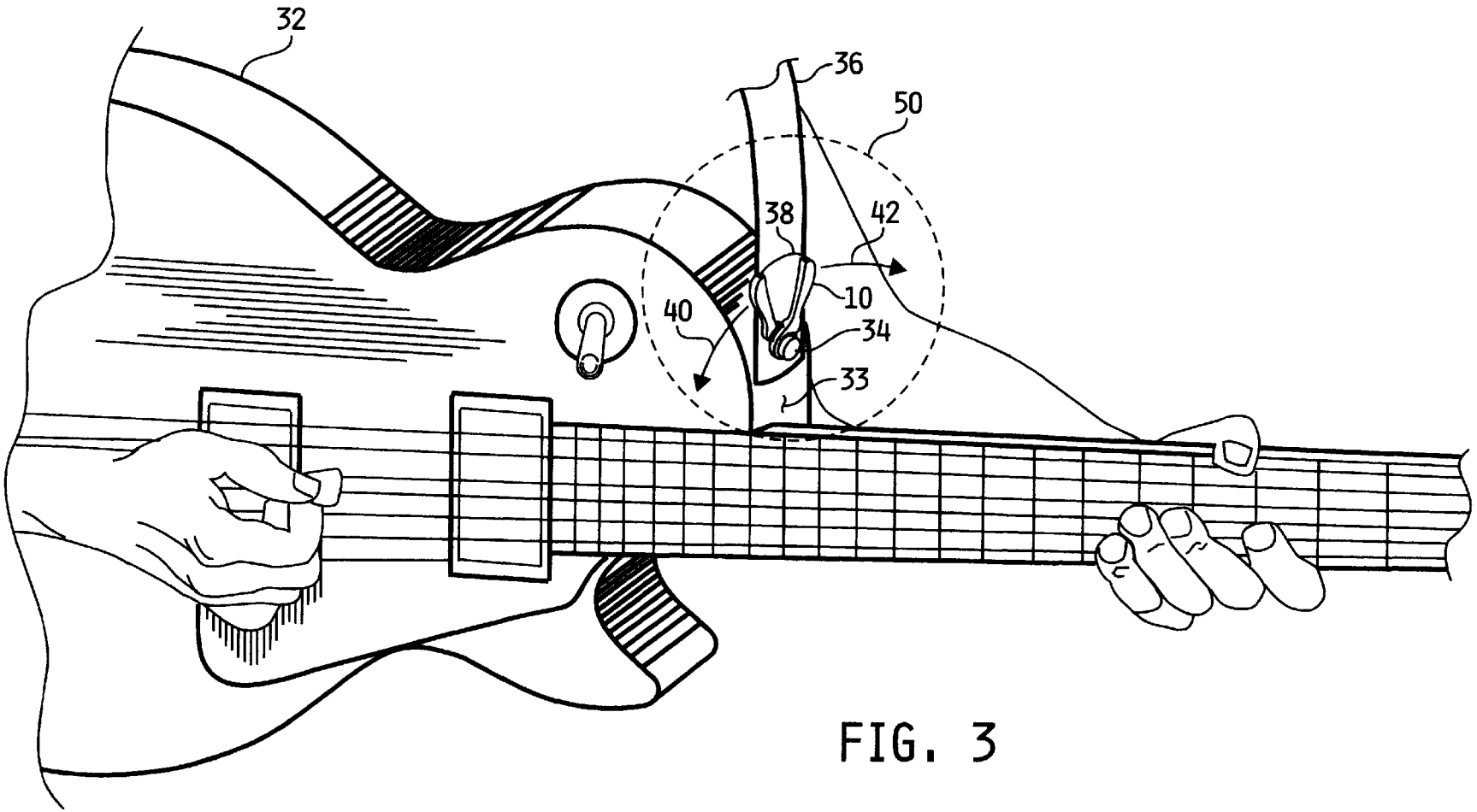
FIG. 3 is a perspective view of a strap supporting a guitar with the combination strap lock and pick storage device of FIGS. 1 and 2 attached thereto in accordance with the present invention.

Referring now to FIG. 3, a guitar 32 is shown having a peg 34 securely affixed to a surface 33 thereof and a support strap 36 attached to the peg 34, whereby the guitar 32 may be suspended by the strap 36 from an individual as shown. A combination strap lock and pick storage device 10 of the present invention is shown positioned about the peg 34 and over the strap 36 to thereby maintain connection of the strap 36 to the peg 34 as will be described in greater detail hereinafter.

Device 10 is illustrated in FIG. 3 as having a guitar pick 38 of known construction disposed within channels 24*a* and 24*b* of arms 12*a* and 12*b* respectively. The device 10 is preferably rotatably positionable about peg 34 as shown graphically by arrows 40 and 42. The term "rotatably positionable" as used with respect to device 10 should be understood to mean that device 10 may be rotated about peg 34 to thereby orient pick 38 in any desired position relative to the guitar 32 as indicated by arrows 40 and 42, wherein the device 10 is configured to maintain the desired position indefinitely.

Figure 4:
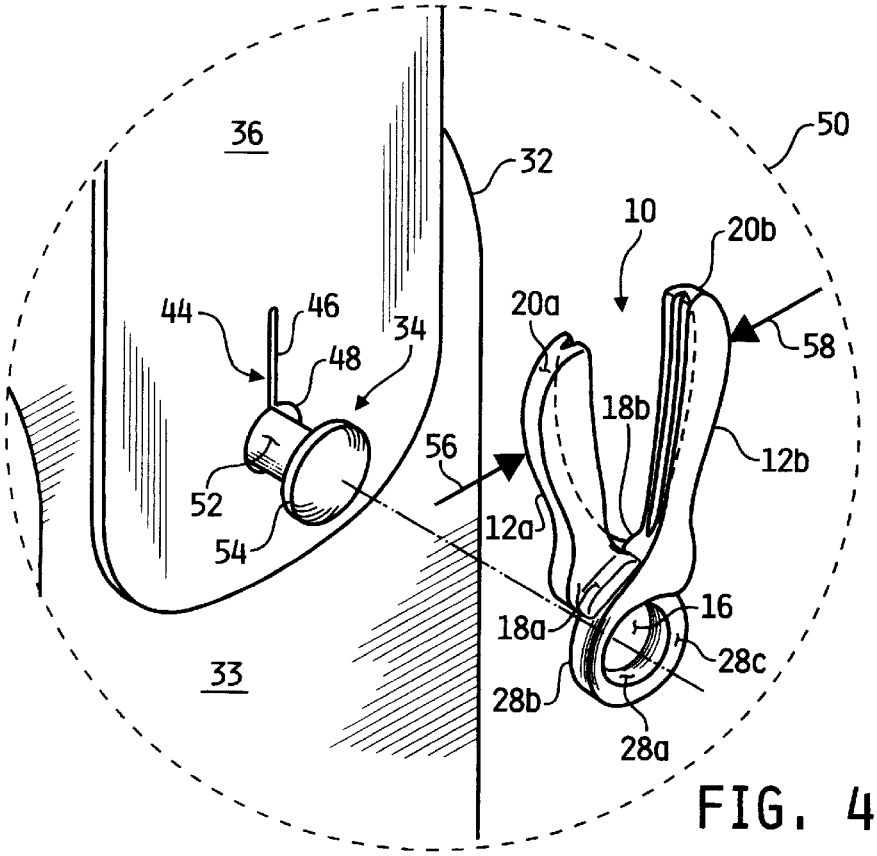
FIG. 4 is a magnified view of a portion of FIG. 3 illustrating attachment of the combination strap lock and pick storage device of FIGS. 1–3 to a guitar peg having a strap fastened thereto.
Figure 5:
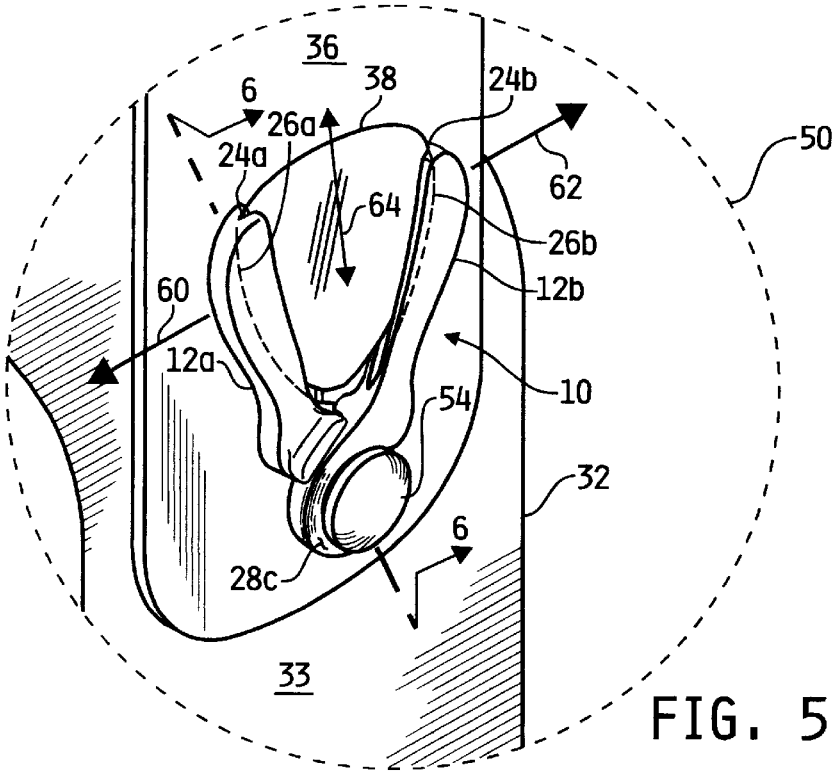
FIG. 5 is a magnified view similar to FIG. 4 illustrating the combination strap lock and pick storage device of FIGS. 1–4 attached to the guitar peg in a strap locking position.

Referring now to FIGS. 4 and 5, a magnified representation of region 50 of FIG. 3 is shown illustrating one preferred procedure for attaching device 10 to peg 34. As shown in detail in FIG. 4, strap 36 defines an aperture 44 of conventional design therethrough, wherein aperture 44 includes a hole 48 having a slit 46 extending therefrom. Peg 34 is also a conventional design having an enlarged head 54 extending from a shaft 52 having a cross-sectional area that is smaller than that of head 54. The opposite end of the shaft 52 is securely affixed to, or into, surface 33 of guitar 32. As is known in the art, the strap 36 is attached to the peg 34 by forcing aperture 44 over the head 54 of peg 34 and onto the shaft 52. As discussed in the BACKGROUND section, aperture 44 of strap 36 will eventually become enlarged due to deformation as a result of normal use thereof, wherein the cross-sectional area of head 54 may no longer be large enough to maintain the aperture 44 disposed about the shaft 52. The aperture 44 of strap 36 may thus slip over the head 54 and thereby disengage the strap from the peg 34 and guitar 32.

To combat this potentially dangerous condition, the combination strap lock and pick storage device 10 of the present invention is configured such that inner surface 28*a* of ring 14 may be temporarily increased, thereby enlarging the cross-sectional area of passage 16, in order to pass over head 54 of peg 34, and then returned to its original size to thereby engage shaft 52 about a substantial portion of its surface. To accomplish this, pressure is applied to each of the outer faces 20*a* and 20*b* of arms 12*a* and 12*b* respectively, as shown by arrows 56 and 58, such as by pinching arms 12*a* and 12*b* between a thumb and forefinger, so that arms 12*a* and 12*b* are biased toward each other. This inward biasing action of arms 12*a* and 12*b* causes protrusion 18*a* to move toward arm 12*b* and protrusion 18*b* to move toward arm 12*a*, which effectively increases the surface area of inner surface 28*a* and resultantly expands passage 16 to a cross-sectional area sufficient to pass over head 54 of peg 34. Without protrusions 18*a* and 18*b*, arms 12*a* and 12*b* may be over-biased toward each other in the above-described process to the extent that deformation of device 10 may result, and in this respect, protrusions 18*a* and 18*b*, or structural equivalents thereof, are preferably included to provide a positive stop to the inward biasing of arms 12*a* and 12*b* toward each other. It is to be understood, however, that the present invention contemplates constructing device 10 of a material or materials having sufficient strength and resiliency so that such deleterious effects of over-biasing are no longer present or possible and, in this case, protrusions 18*a* and 18*b* may be omitted.

With the inner surface 28*a* positioned about shaft 52, the pressure on outer faces 20*a* and 20*b* of arms 12*a* and 12*b* respectively is released, and the natural outward bias existing between arms 12*a* and 12*b* causes arms 12*a* and 12*b* to draw away from each other and return substantially to their original positions (see FIG. 1), thereby returning the surface area of the inner surface 28*a* of ring 14 to its original dimension and the cross-sectional area of opening 16 to its original cross-sectional area. Preferably, device 10 is configured so that the original cross-sectional area of opening 16 (i.e., with no external pressure applied to arms 12*a* and 12*b*) is sized such that the inner surface 28*a* of ring 14 contacts a substantial area of shaft 52 thereabout so that the device 10 may be rotatably positioned about shaft 52 as described hereinabove. Those skilled in the art will recognize that the shape and configuration of the ring 14 and opening 16 will generally be dictated by the corresponding shape and configuration of the shaft 52 and head 54 of the peg 34, although all such structures are illustrated in the drawings as having generally circular cross-sections.

In any event, the front and rear faces 28*c* and 28*b* respectively of ring 14 are preferably sized such that the entire ring 14, when affixed to shaft 52, is larger in cross-sectional area than the head 54 of peg 34 as shown in FIG. 5. The ring 14 is thus preferably sized to add sufficient cross-sectional area about shaft 52 so that the aperture 44, even though possibly enlarged due to repeated forcing of aperture 44 over head 54, will not pass over ring 14. In this manner, device 10 provides a strap locking feature when positioned about shaft 52 of peg 34 between head 54 and aperture 44 of strap 36.

As most clearly shown in FIG. 5, and as described hereinabove, inner faces 22*a* and 22*b* of arms 12*a* and 12*b* each define channels 24*a* and 24*b* therein, wherein such channels are preferably configured to receive first and second opposite edges of a conventional guitar pick therein, and retain the pick between arms 12*a* and 12*b*. In one preferred embodiment, and as described with respect to FIG. 1, the channel surfaces 26*a* and 26*b* are arcuate-shaped. Preferably the arcuate shape of channel surfaces 26*a* and 26*b* in this embodiment is complementary to first and second opposite edges of a conventional guitar pick configuration to thereby facilitate advancement and retrieval of a pick 38 within and from channels 24*a* and 24*b* as shown by the bi-directional arrow 64 of FIG. 5. It is to be understood, however, that channel surfaces 26*a* and 26*b* may alternatively be configured complementary to corresponding edges of any desired pick configuration to facilitate advancement and retrieval of any such pick configuration. In any case, and with further reference to FIG. 5, channel surfaces 26*a* and 26*b* preferably extend within inner surfaces 22*a* and 22*b* respectively of arms 12*a* and 12*b* to define a distance therebetween that is slightly narrower than the width of pick 38. Insertion of the pick 38 within channels 24*a* and 24*b* thus preferably causes a slight outward biasing of arms 12*a* and 12*b* away from each other, as illustrated graphically by biasing arrows 60 and 62, thereby causing a further reduction in the cross-sectional area of passage 16 to a cross-sectional area slightly less than that established by the natural outward biasing of arms 12*a* and 12*b* as described hereinabove. As a result, the inner surface 28*a* of ring 14 fits securely about shaft 52 of peg 34, yet the entire structure (device 10 with pick 28 inserted therein) is roatably positionable about shaft 52 as described hereinabove. This supplemental biasing of arms 12*a* and 12*b*, while not required, thus facilitates the ability to fixedly locate device 10 at any desired position relative to the guitar 32 and/or strap 36.

Figure 6:
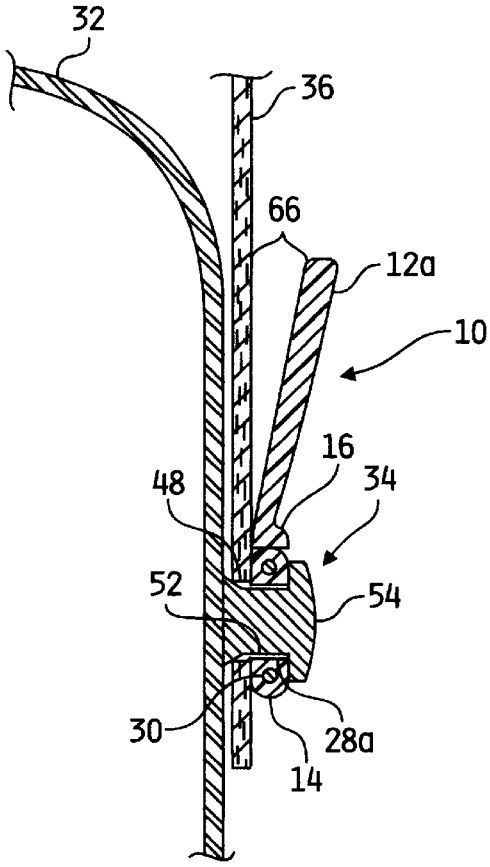
FIG. 6 is a cross-sectional view of the guitar, strap, peg and combination strap lock and pick storage device of FIG. 5 viewed along section lines 6—6.

Referring now to FIG. 6, a cross-section of device 10, strap 36, peg 34 and guitar 32, viewed along section lines 6—6 of FIG. 5, is shown illustrating another preferred feature of device 10. In particular, arms 12*a* and 12*b* are preferably disposed at an acute angle relative to a first axis perpendicular to a second axis defined through a center of opening 16 in ring 14. As shown in FIG. 6, arms 12*a* and 12*b* are disposed at an acute angle 66 relative to a vertical axis normal to a horizontal axis defined longitudinally through the center of the peg 34, to thereby provide some clearance between the arms 12*a* and 12*b* and the support strap 36. Preferably, sufficient clearance is provided to allow a finger or thumb to slide between the strap 36 and a pick 38 stored within channels 24*a* and 24*b* to thereby facilitate advancement and withdrawal of the pick 38 within and from device 10. Preferably, arms 12*a* and 12*b* are angled from the free ends thereof to approximately the locations of protrusions 18*a* and 18*b*, although the present invention contemplates angling or bowing any portion of arms 12*a* and 12*b* to thereby provide some clearance between the back faces 19*b* thereof and the strap 36.

Figure 7:
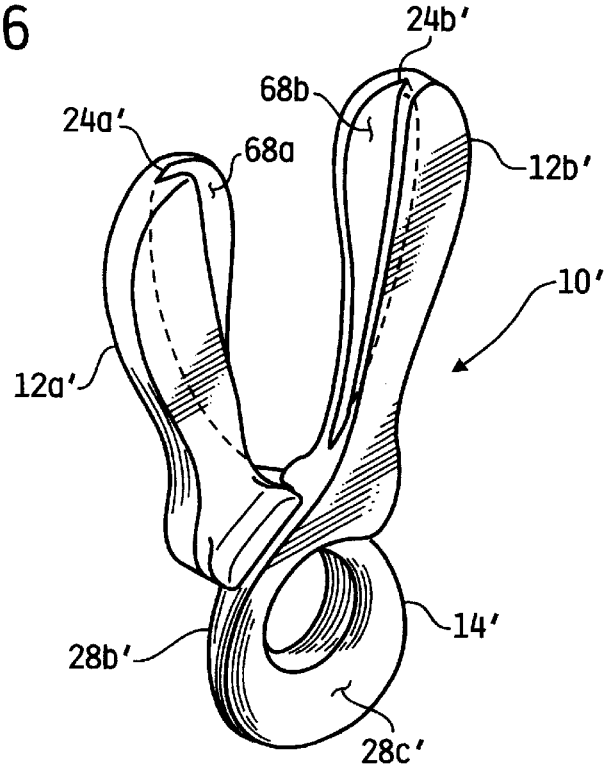
FIG. 7 is a front perspective view of an alternate embodiment of a combination strap lock and pick storage device, in accordance with the present invention.

Referring now to FIG. 7, an alternate embodiment 10' of a combination strap lock and pick storage device, in accordance with the present invention, is shown. Device 10' is identical in many respects to device 10 illustrated in FIGS. 1–6 with at least two exceptions. First, the front face 28*c*' and back face 28*b*' of ring 14' are extended to form a flange rather than a ring-like structure as shown in FIG. 1. The flange formed by faces 28*b*' and 28*c*' is intended to illustrate that ring 14 may be sized to form any desired outer diameter for any correspondingly sized peg 34 and/or for increased strap locking capability. Second, arms 12*a*' and 12*b*' have been reconfigured to provide for a pair of wing-like structures 68*a* and 68*b* extending at least partially along one edge of corresponding channels 24*a*' and 24*b*' to act as guides for facilitating advancement of a pick 38 within channels 24*a*' and 24*b*'. Preferably, the wing-like structures 68*a* and 68*b* extend along only a portion of channels 24*a*' and 24*b*' near the free ends of arms 12*a*' and 12*b*' , although the present invention contemplates other configurations of wing-like structures 68*a* and 68*b*.

Figure 8:
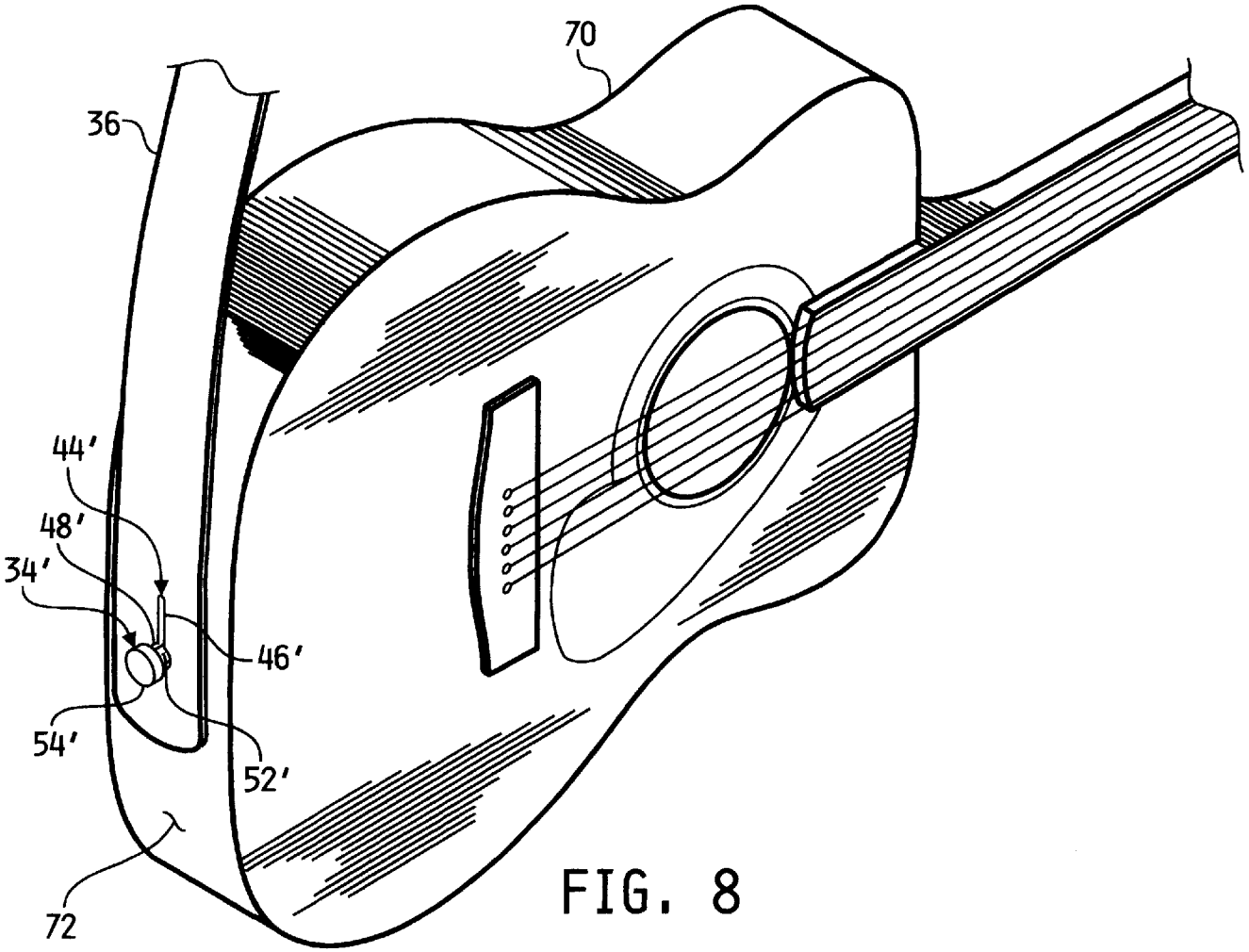
FIG. 8 is a perspective view of a rear portion of a guitar having a strap attached thereto illustrating an alternate or additional location of one of the combination strap lock and pick storage devices of the present invention.

Referring now to FIG. 8, a front perspective view of another guitar 70 is shown illustrating the location of a rear peg 34' that is conventionally affixed centrally to the bottom 72 of the guitar 70. As with the front peg 34 illustrated in FIGS. 3–6, the rear peg 34' includes an enlarged head 54' having a shaft 52' extending therefrom wherein the shaft 52' defines a cross-sectional area that is less than that of head 54'. The free end of peg 34' is typically affixed to, or within, the bottom 72 of the guitar 70. The strap 36 likewise defines a second aperture 44' therethrough similar to the first aperture 44 defined at the opposite end, including an opening 48' having a slit 46' extending therefrom. The strap 36 may be connected to peg 34' in a manner similar to that described with respect to peg 34, whereby a combination strap lock and pick storage device 10 or 10' of the present invention may be attached to peg 34' in an identical manner to that described with respect to peg 34.

Figure 9:
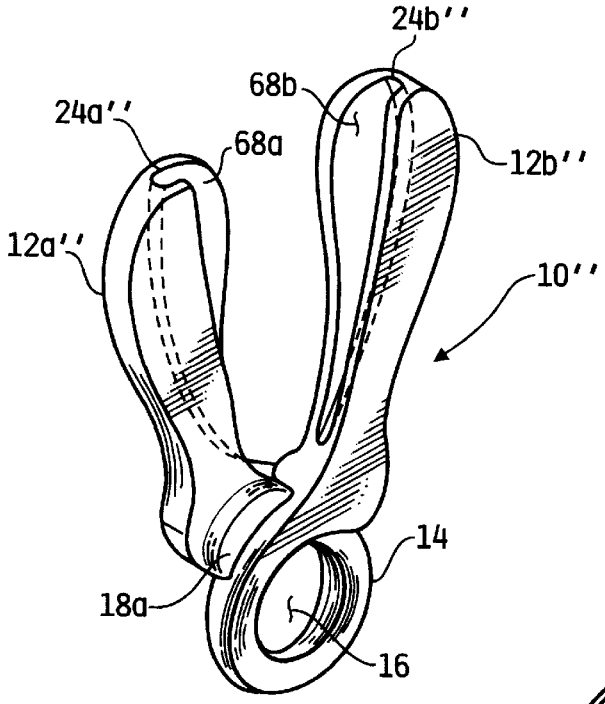
FIG. 9 is a perspective view of another alternate embodiment of a combination strap lock and pick storage device, in accordance with the present invention.

Referring now to FIG. 9, an alternate embodiment 10" of a combination strap lock and pick storage device, in accordance with the present invention, is shown. Device 10" is identical in many respects to device 10 illustrated in FIGS. 1–6 with at least two exceptions. First, as with device 10' illustrated in FIG. 7, arms 12*a*" and 12*b*" have been reconfigured to provide for a pair of wing-like structures or lobes 68*a* and 68*b* extending at least partially along one edge of corresponding channels 24*a*" and 24*b*" to act as guides for facilitating advancement of a pick 38 within channels 24*a*" and 24*b*". Preferably, the wing-like structures or lobes 68*a* and 68*b* extend along only a portion of channels 24*a*" and 24*b*" near the free ends of arms 12*a*" and 12*b*", although the present invention contemplates other configurations of wing-like structures 68*a* and 68*b*, wherein a primary importance of any such alternate configuration lies in its ability to facilitate entrance/exit of a pick 38 therein/therefrom. A second exception is that channels 24*a*" and 24*b*" have been widened to accept a plurality of picks therein and/or single picks having substantial thickness. For example, in one embodiment, channels 24*a*" and 24*b*" are sized to accept 4–6 standard medium thickness (e.g., 0.75 mm) picks for storage between arms 12*a*" and 12*b*". In another embodiment, channels 24*a*" and 24*b*" are sized to accept a heavy thickness (e.g., 2.0–3.0 mm) pick therein for storage between arms 12*a*" and 12*b*". It is to be understood, however, that the present invention contemplates sizing channels 24*a*" and 24*b*" to accept any number of picks having any desired thickness, and that any such channel configurations are intended to fall within the scope of the present invention.

Figure 10:
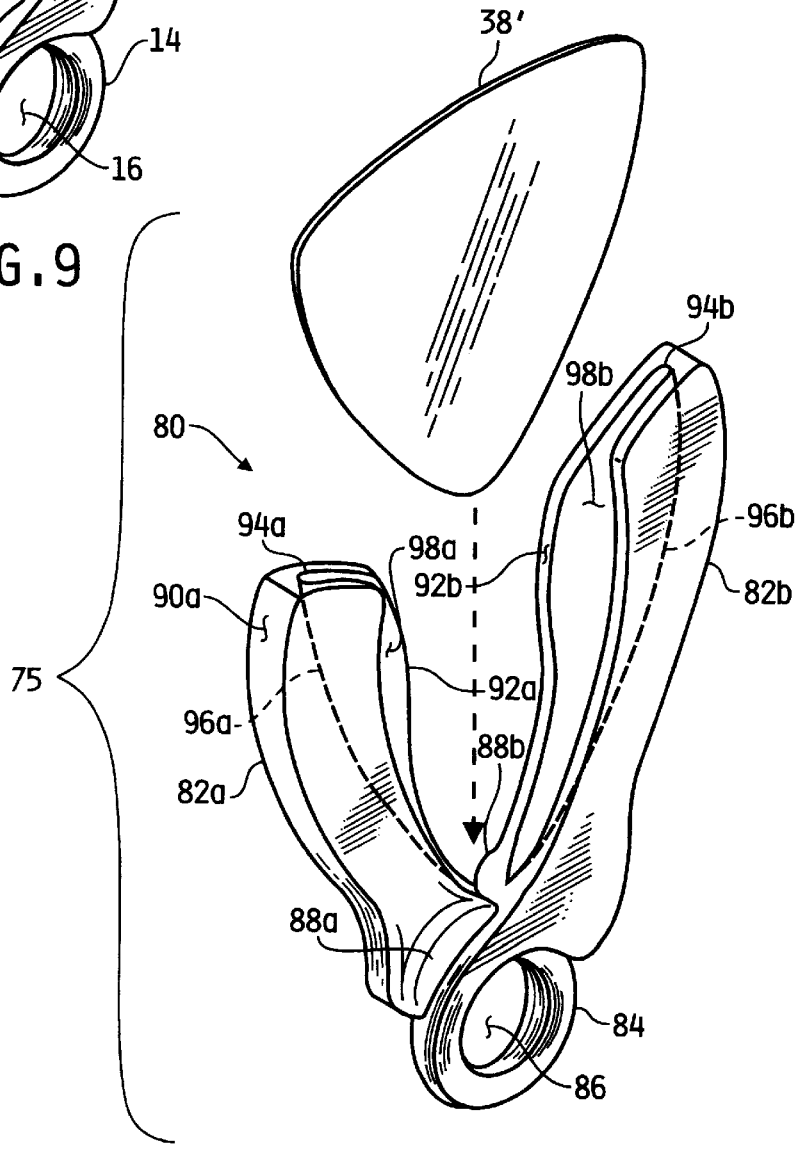
FIG. 10 is a perspective view of yet another alternate embodiment of a combination strap lock and pick storage device, in accordance with the present invention.

Referring now to FIG. 10, another alternate embodiment 80 of a combination strap lock and pick storage device, in accordance with the present invention, is shown. Device 80 is similar in many respects to devices 10' and 10" illustrated in FIGS. 7 and 9 respectively except that device 80 is specifically configured to store therein a larger and generally triangular musical instrument pick 32', wherein the configuration of pick 32' is of the type commonly used by bass guitar musicians and/or players of other musical instruments using heavy gauge strings. Device 80 includes a first arm 82*a* and a second opposite arm 82*b* each having a free end and an opposite end forming a single ring 84 defining a passage 86 therethrough. In one embodiment, the ring 84 is preferably annular in shape and forms a substantially circular passage 86 therethrough, although the present invention contemplates that the ring 84 may be any desired shape forming a passage 86 therethrough having any desired configuration.

Each arm 82*a* and 82*b* further includes a corresponding protrusion 88*a* and 88*b* extending from corresponding front and rear faces thereof adjacent to the ring 84. Preferably, protrusions 88*a* and 88*b* are positioned in slidable contact with an outer surface of the ring 84 and provide the same function as protrusions 18*a* and 18*b* of device 10 as described hereinabove.

Arm 82*a* of device 80 defines an outside face 90*a* and an opposite inside face 92*a*, and arm 82*b* similarly defines an outside face 90*b* and an opposite inside face 92*b*. Faces 92*a* and 92*b* each define a channel therein 94*a* and 94*b* respectively. In one preferred embodiment, channels 94*a* and 94*b* are identically configured, and each extend into faces 92*a* and 92*b* respectively to define generally triangular-shaped channel surfaces 96*a* and 96*b*, although the present invention contemplates other configurations of channel surfaces 96*a* and 96*b*. In the embodiment illustrated in FIG. 10, channels 96*a* and 96*b* are configured as shown and described to receive therein opposite edges of pick 32' for storage between arms 90*a* and 90*b* in an identical manner to that described hereinabove with respect to device 10. Alternatively, channels 94*a* and 94*b* may be configured to receive multiple picks and/or at least one heavy gauge pick as described hereinabove with respect to FIG. 9. Like device 10' of FIG. 7 and device 10" of FIG. 9, device 80 further includes a pair of wing-like structures or lobes 98*a* and 98*b* extending at least partially along one edge of corresponding channels 94*a* and 94*b* to act as guides for facilitating advancement of a pick 38' within channels 94*a* and 94*b*. Preferably, the wing-like structures or lobes 98*a* and 98*b* extend along only a portion of channels 94*a* and 94*b* near the free ends of arms 82*a* and 82*b*, although the present invention contemplates other configurations of wing-like structures 98*a* and 98*b*, wherein a primary importance of any such alternate configuration lies in its ability to facilitate entrance/exit of a pick 38' therein/therefrom.

Apart from the structural differences noted with respect to FIG. 10, device 80 is otherwise identical in function to devices 10, 10' and 10" described herein. In particular, arms 82*a* and 82*b* may be advanced inwardly toward each other to increase the cross-sectional area of passage 86 so as to receive the head portion of a musical instrument strap attachment peg therethrough. After advancing device 80 past the head portion, arms 82*a* and 82*b* may be released to thereby decrease the cross-sectional area of passage 86. Preferably, passage 86 is sized such that an inner surface of ring 84 grips a shaft portion of the musical instrument peg. Thereafter, a pick 32' may be advanced into channels 94*a* and 94*b* such that the composite device 75 provides a combination strap locking and pick holding device for use with a stringed instrument such as, for example, a bass guitar.

Figure 11:
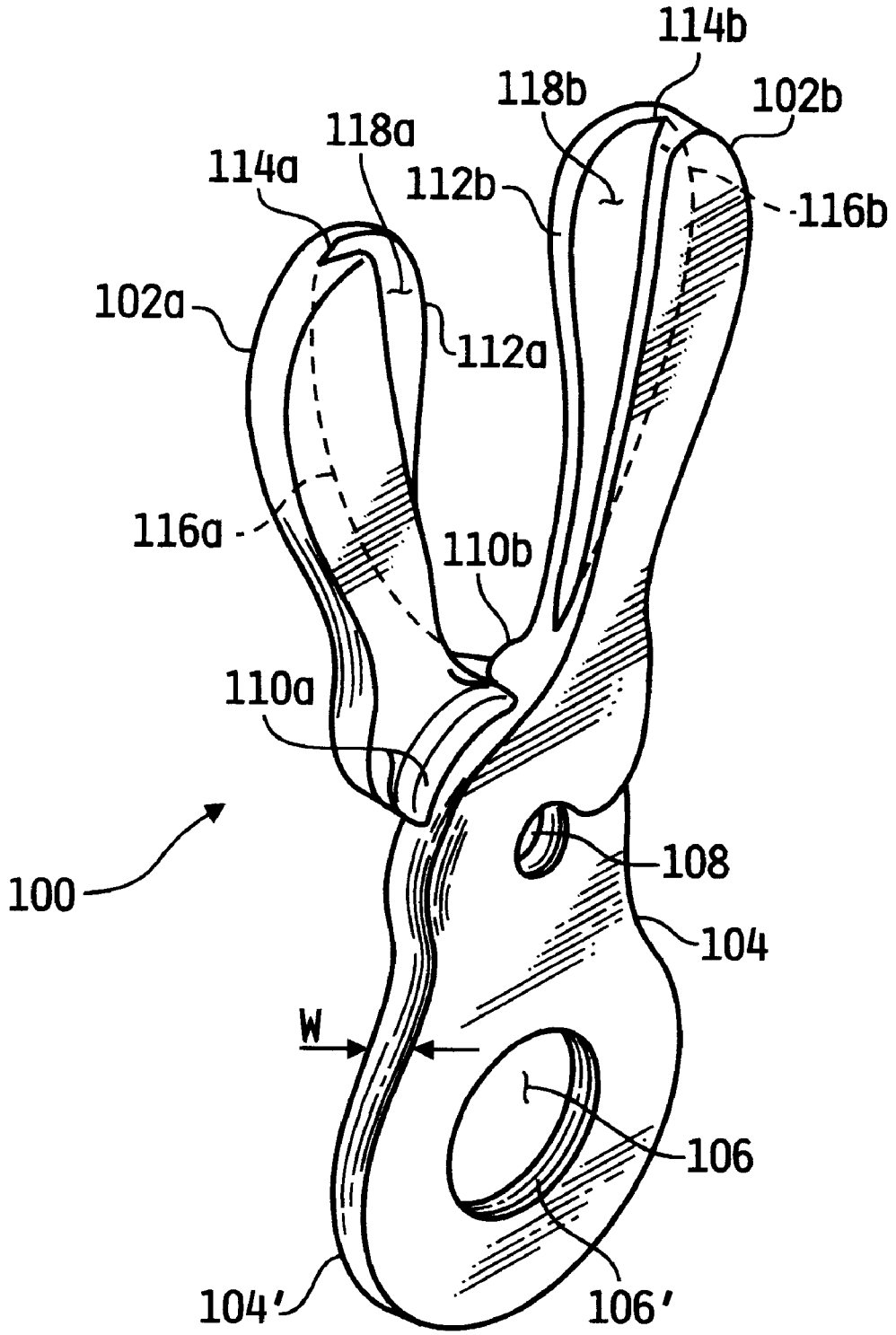
FIG. 11 is a perspective view of one embodiment of a pick storage device securable to an existing strap locking device, in accordance with another aspect of the present invention.

Referring now to FIG. 11, one preferred embodiment of a pick storage device 100 for use with an existing strap locking device of known construction, in accordance with another aspect of the present invention, is shown. Device 100 includes a first arm 102*a* and a second opposite arm 102*b* each having a free end and an opposite end extending into a washer member 104. Washer member 104 defines an outer washer surface 104' and a first passage 106 therethrough defining an inner passage surface 106'. Washer member 104 defines a second passage 108 therethrough located between arms 102*a* and 102*b* to provide for movement of arms 102*a* and 102*b* relative to each other.

In one embodiment, washer member 104 is configured to be substantially flat along a plane normal to an axis extending centrally through passage 106. In this embodiment, outer washer surface 104' defines a width "W" that is preferably sized similar to a washer forming part of an existing strap locking device as will be described more fully hereinafter. The present invention contemplates, however, that washer member 104 may alternatively configured, wherein a primary importance of any such alternative configuration lies in its ability to be easily integrated into an existing strap locking device or system.

In any case, each arm 102*a* and 102*b* further includes a corresponding protrusion 110*a* and 110*b* extending from corresponding front and rear faces thereof adjacent to the washer member 104. Preferably, protrusions 10*a* and 110*b* are positioned in slidable contact with outer surface 104' of washer member 104 and provide the same function as protrusions 18*a* and 18*b* of device 10 as described hereinabove.

Arm 102*a* and 102*b* defines opposing inner arm faces 112*a* and 112*b* respectively, wherein faces 112*a* and 112*b* each define a channel therein 114*a* and 114*b* respectively. In one preferred embodiment, channels 114*a* and 114*b* are identically configured, and each extend into faces 112*a* and 112*b* respectively to define generally arcuate-shaped channel surfaces 116*a* and 116*b* for receiving a musical instrument pick therein for storage between arms 102*a* and 102*b*, although the present invention contemplates other configurations of channel surfaces 116*a* and 116*b* such as, for example, those illustrated in FIG. 10. Alternatively, channels 114*a* and 114*b* may be configured to receive multiple picks and/or at least one heavy gauge pick as described hereinabove with respect to FIG. 9. Device 100 further includes a pair of wing-like structures or lobes 118*a* and 118*b* extending at least partially along one edge of corresponding channels 114*a* and 114*b* to act as guides for facilitating advancement of one or more musical instrument picks within channels 114*a* and 114*b*. Preferably, the wing-like structures or lobes 118*a* and 118*b* extend along only a portion of channels 114*a* and 114*b* near the free ends of arms 102*a* and 102*b*, although the present invention contemplates other configurations of winglike structures 118*a* and 118*b*, wherein a primary importance of any such alternate configuration lies in its ability to facilitate entrance/exit of one or more picks therein/therefrom.

Figure 12:
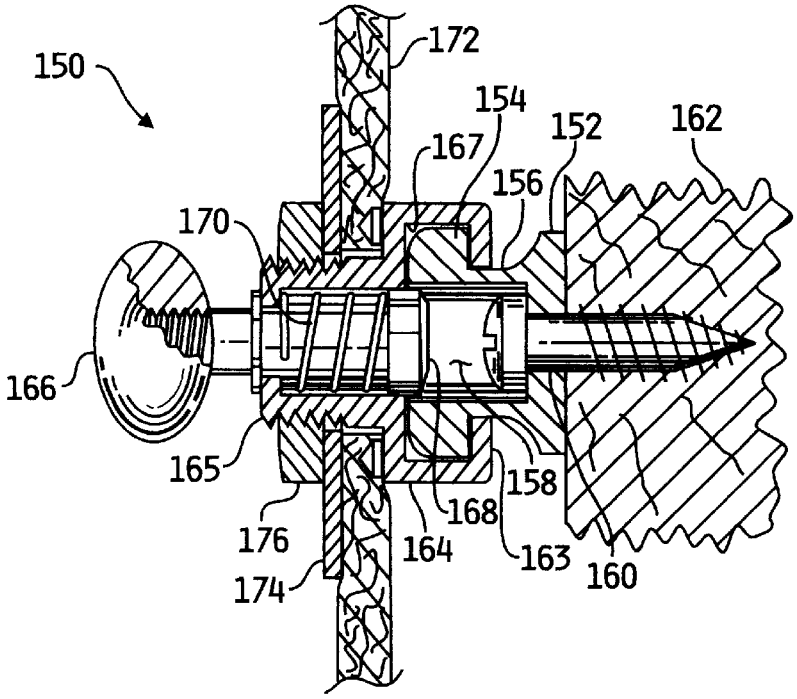
FIG. 12 (PRIOR ART)
FIG. 12 is a cross-sectional view of one prior art musical instrument strap locking device.

Device 100 is operable as described hereinabove to store one or more musical instrument picks within channels 114*a* and 114*b*; i.e., between arms 102*a* and 102*b*. Unlike the previous embodiment described above, however, washer member 104 is configured such that device 100 may be easily integrated into the structure of an existing strap locking device. An example of one known strap locking device 150 is illustrated in FIG. 12, wherein device 150 includes a strap attachment peg 152 configured for locking engagement with a strap coupling unit 164. The peg 152 includes an outer surface defining an enlarged head portion 154 that tapers down to a reduced-diameter shaft portion 156, wherein peg 152 defines a bore 158 extending through the head portion 154 and also through the shaft portion 156. A screw or other fixation member 160 extends through bore 158 and is configured to attach peg 152 to a surface 162 of a musical instrument. Coupling unit 164 includes a cavity receiving a plunger 168 connected by a shaft to a head 166 with a spring member 170 disposed over the shaft between the head 166 and plunger 168. Coupling unit 164 defines a U-shaped catch 163 defining an inner surface 167 sized to receive the head portion 154 of peg 152 therein. The plunger 168 is biased by spring 170 such that it normally extends into the U-shaped catch 163 and into bore 158 when catch 163 is received over the head portion 154 of peg 152 to thereby lock the coupling unit 164 to the peg 152. The plunger 168 may be retracted from catch 163 by forcing head 166 away from coupling unit 174, wherein the coupling unit 164 may then easily be disengaged from peg 152.

The coupling unit 164 of strap locking device 150 may be secured to a musical instrument strap 172 by extending a neck portion 165 of unit 164 through the strap 172, wherein neck portion 165 is typically threaded as illustrated in FIG. 12. A washer 174 is then disposed over the neck portion 165 and a threaded collar 176 is advanced onto the neck portion 165 to thereby secure the coupling unit 164 to the strap 172. With the coupling unit 164 mounted to the instrument strap 172, the strap 172 may be "locked" to the musical instrument 162 by guiding the U-shaped catch 163 onto the head portion 154 of peg 152 such that the plunger 168 extends into bore 158. The strap may be removed from peg 152 by retracting the plunger 168 from bore 158 as described hereinabove and removing the U-shaped catch 163 from the head portion 154 of peg 152. Further details relating to strap locking device 150 may be found in U.S. Pat. No. 4,274,181 to Schaller, the contents of which are incorporated herein by reference.

Figure 13:
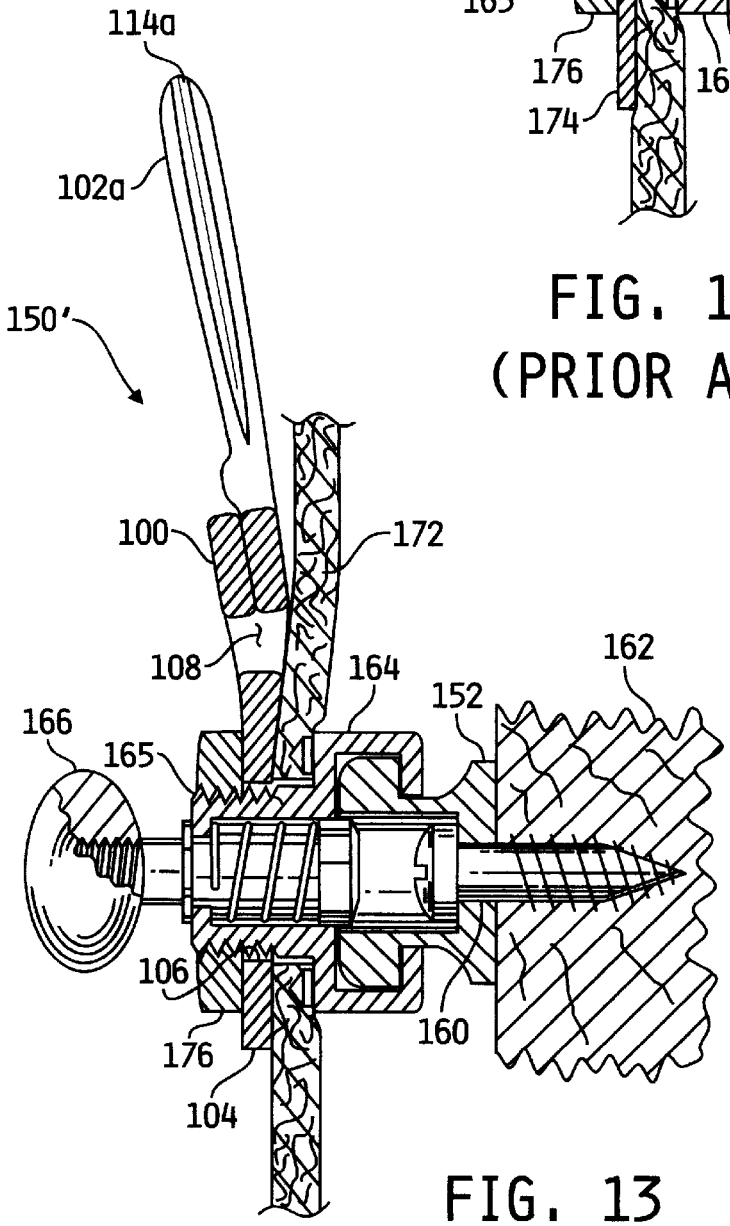
FIG. 13 is a cross-sectional view of the prior art musical instrument strap locking device of FIG. 12 shown with the pick storage device of FIG. 11 secured thereto.

Referring now to FIG. 13, the strap locking device 150 of FIG. 12 is shown with the pick holding device 100 of the present invention incorporated therein to form a strap locking and pick storage device 150' in accordance with another aspect of the present invention. With this embodiment, the washer 174 of strap locking device 150 is replaced with the washer member 104 of device 100 such that device 100 is trapped between collar 176 and the musical instrument strap 172. In this case, the passage 106 of washer member 104 is sized slightly larger than the cross-sectional area of neck portion 165 of the coupling unit 164 so that device 100 may be easily incorporated into the strap locking device 150. In this manner, the pick storing device 100 of the present invention may be easily secured to a musical instrument strap such that one or more musical instrument picks stored therein may be easily accessible adjacent to any one or more strap attachment pegs located on the instrument.

Figure 14:
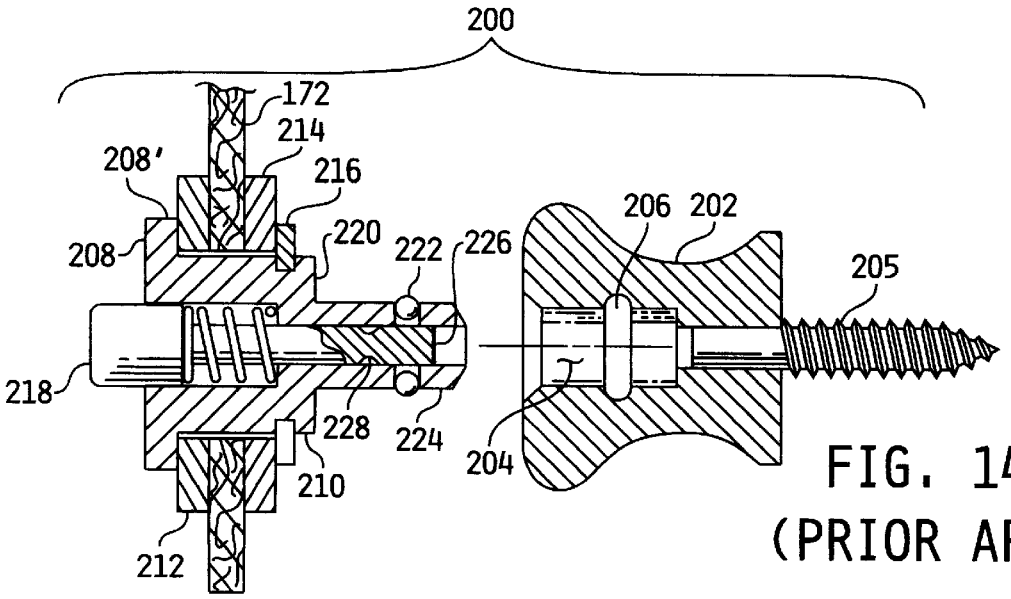
FIG. 14 (PRIOR ART)
FIG. 14. is a cross-sectional view of another prior art musical instrument strap locking device.

Referring now to FIG. 14, an example of another known strap locking device 200 is illustrated, wherein device 200 includes a strap attachment peg 202 configured for locking engagement with a strap coupling unit 208. The peg 202 defines a bore 204 therethrough with a catch groove 206 defined therein and generally about the bore 204. A screw or other fixation member 205 extends from peg 202 and is configured to attach peg 202 to a surface of a musical instrument (not shown). Coupling unit 208 includes shaft 224 defining a cavity receiving a plunger 226 connected by a shaft to a head 218 with a spring member 220 disposed over the shaft between the head 218 and plunger 226. The shaft 224 of coupling unit 208 is sized to be received within the bore 204 of peg 202. The shaft 224 further carries at least two spheres 222 near its distal end, and plunger 226 defines a corresponding number of detents 228 sized to at least partially receive the spheres 222 therein. The plunger 226 is biased by spring 220 such that it normally extends into the shaft 224 with detents 228 positioned between head 218 and spheres 222. Coupling unit 208 is secured to peg 202 by advancing head 218 toward spheres 222 until the detents 228 align with, and receive therein, the spheres 222. Shaft 224 is then advanced into bore 204 until spheres 222 become trapped therein. The head 218 is then released and the shaft 224 is extended into bore 204 until the spheres 222 are received within catch groove 206 thereby securing coupling unit 208 to peg 202. The coupling unit 208 may be released from peg 202 by advancing head 218 toward spheres 222 until the detents 228 align with, and receive therein, the spheres 222. With the spheres received within detents 228, the shaft 224 is retracted from bore 204 to thereby disengage the coupling unit 208 from the peg 202.

The coupling unit 208 of strap locking device 200 may be secured to a musical instrument strap 172 by extending a neck portion 210 of unit 208 through the strap 172, wherein neck portion 210 is disposed between head 218 and shaft 224. A first washer 212 is positioned between a flange 208' of coupling unit 208 and the strap 172, and a second washer 214 is then advanced over the shaft 224 and neck portion 210, and positioned adjacent to the strap 172. A locking collar 216 is advanced onto the neck portion 210 in a known manner to thereby secure the coupling unit 208 to the strap 172. With the coupling unit 202 mounted to the instrument strap 172, the strap 172 may be "locked" to, and unlocked from, the musical instrument peg 202 as just described. Further details relating to strap locking device 200 may be found in U.S. Pat. No. 4,144,794 to Silverman et al., the contents of which are incorporated herein by reference.

Figure 15:
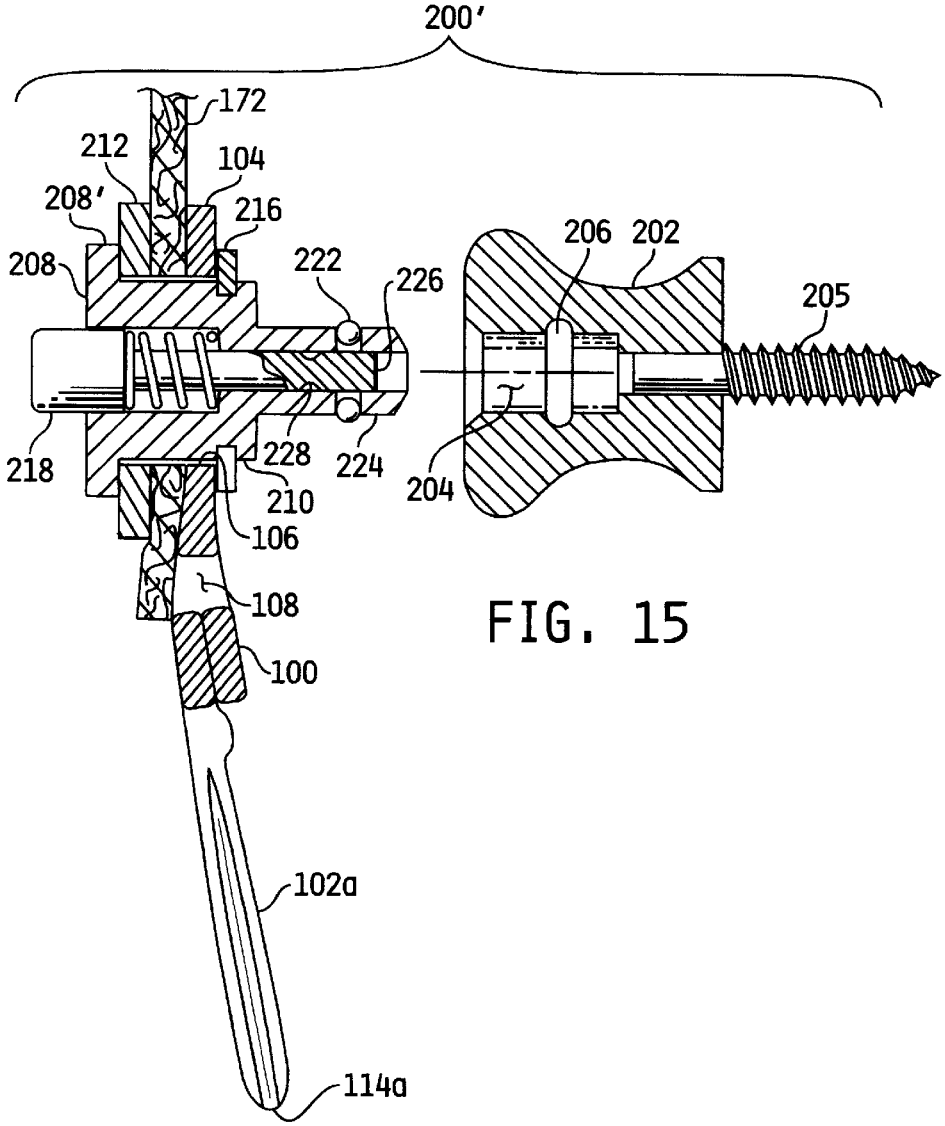
FIG. 15 is a cross-sectional view of the prior art musical instrument strap locking device of FIG. 14 shown with the pick storage device of FIG. 11 secured thereto.

Referring now to FIG. 15, the strap locking device 200 of FIG. 14 is shown with the pick holding device 100 of the present invention incorporated therein to form a strap locking and pick storage device 200' in accordance with another aspect of the present invention. With this embodiment, either of the washers 212 or 214 of strap locking device 200 are replaced with the washer member 104 of device 100 such that device 100 is secured to the musical instrument strap 172. In FIG. 15, for example, the washer member 104 is shown replacing washer 214 such that the pick holding device 100 is trapped between the strap 172 and the locking collar 216. Alternatively, the washer member 104 may replace washer 212 such that the pick holding device 100 is trapped between the strap 172 and the flange 208' of coupling unit 208. In either case, the passage 106 of washer member 104 is sized slightly larger than the cross-sectional area of neck portion 210 of the coupling unit 208 so that device 100 may be easily incorporated into the strap locking device 200. In this manner, the pick storing device 100 of the present invention may be easily secured to a musical instrument strap such that one or more musical instrument picks stored therein may be easily accessible adjacent to any one or more strap attachment pegs located on the instrument.

Figure 16:
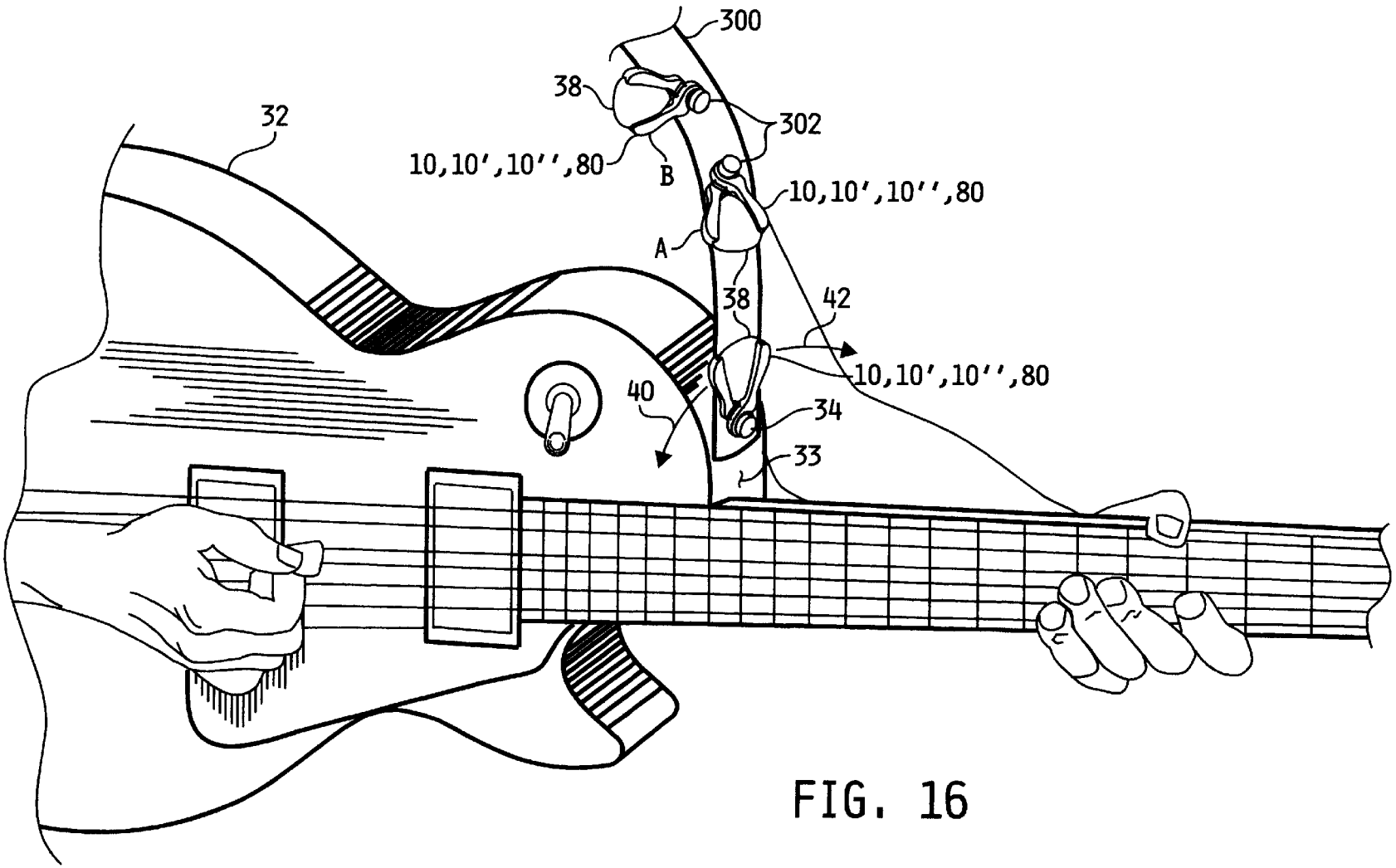
FIG. 16 is a perspective view of a strap supporting a guitar with a number of strap locking and pick storage device of the present invention attached thereto, in accordance with another aspect of the present invention.

Referring now to FIG. 16, another application of the strap locking and pick storage device 10, 10', 10" or 80 of the present invention is shown in its capacity as a pick storage device. FIG. 16 is identical in many respects to FIG. 3, and like structure thereof is accordingly identified with like reference numbers. Unlike the embodiment shown in FIG. 3, however, the musical instrument strap 300 of FIG. 16 is configured for mounting or otherwise securing a number of pick storage devices 10, 10', 10", 80 or 100 along at least a portion of the strap 300 within easy reach of the musician. For example, the strap 300 may be provided with one or more attachment structures 302 affixed thereto, wherein device 10, 10', 10", 80 or 100 may be mounted to any one or more such structures 302. One or more musical instrument picks 38 (or 38') may then be stored in any of these devices 10, 10', 10", 80 or 100 at any desired location along strap 300 to thereby provide a supply of picks within easy reach of the musician. In one embodiment, structure 302 may be a button or similar device that may be sewn onto, or otherwise affixed to, strap 300. In this embodiment, the button or similar device 302 includes a head portion affixed to the strap 300 via an appropriate mounting medium (e.g., thread), wherein device 10, 10', 10" or 80 may be attached to structure 302 as described herein with respect to FIGS. 3–6 with the ring 14, 14' or 84 trapped between a back side of the button or similar device 302 and the strap 300. However, in this embodiment, the device 10, 10', 10" or 80 is typically not rotatably positionable about structure 302 as described hereinabove with respect to FIG. 3, and device 10, 10', 10" or 80 therefore generally hangs downwardly from structure 302 as indicated at "A". Alternatively, structure 302 may include a reduced diameter shaft similar to that of musical instrument peg 34 of FIG. 3, in which case device 10, 10', 10" or 80 may be rotatably positionable about structure 302 as shown and described with respect to FIG. 3, and may accordingly be oriented for easy access by the musician as indicated, for example, at "B". Alternatively still, structure 302 may comprise at least one flexible strand, loop or pair of flexible laces affixed to, or integral with, strap 300, whereby device 10, 10', 10", 80 or 100 may be attached thereto in known fashion. In yet another alternative embodiment, structure 302 may comprise a rigid member defining a bore therethrough such as, for example, a ring, washer or other structure, whereby device 10,10', 10" or 80 may be mounted thereto by passing one of the arms through the bore and positioning device 10, 10', 10" or 80 such that ring 14, 14' or 84 is supported by structure 302. In a further embodiment, structure 302 may comprise a clip or similar structure affixed to strap 300 and configured for gripping ring 14, 14' or 84, or washer member 104 to thereby affix device 10, 10', 10", 80 or 100 to strap 300. Those skilled in the art will recognize other embodiments of structure 302 for mounting device 10, 10', 10", 80 or 100 thereto, and all such other structures are intended to fall within the scope of the present invention.

It will be apparent to those skilled in the art that the combination strap lock and pick storage device 10, 10', 10" or 80 of the present invention may be used strictly in its capacity as a strap locking device wherein one such device may be attached to peg 34 or 34' to thereby secure the strap 36 to a guitar 32 or 70 at a location that has a tendency to become unconnected in the normal course of use, or wherein two such devices may be attached to pegs 34 and 34' to thereby cheaply, easily and securely lock a strap 36 to a guitar 32 or 70. Alternatively, the combination strap lock and pick storage device 10, 10', 10", 80 or 100 of the present invention may be used strictly in its capacity as a pick storage device wherein one or more such devices 10, 10', 10", 80 or 100 may be attached to a peg 34 or 34', with or without a strap 36 connected thereto (or attached to a strap 172 via an existing strap locking device in the case of device 100), to provide for one or more easily accessible surplus of picks. Alternatively still, the combination strap lock and pick storage device 10, 10', 10" or 80 of the present invention may be used in its dual capacity as a strap locking device and pick storage device wherein one or more such devices 10, 10', 10" or 80 may be attached to an appropriate peg 34 or 34' to thereby secure a support strap 36 to a guitar 32 or 70, and wherein a pick may be stored within each such device 10, 10', 10" or 80 to thereby provide one or more easily accessible surplus of picks.

While the invention has been illustrated and described in detail in the foregoing drawings and description, the same is to be considered as illustrative and not restrictive in character, it being understood that only the preferred embodiments have been shown and described and that all changes and modifications that come within the spirit of the invention are desired to be protected. For example, while the device 10, 10', 10", 80 or 100 of the present invention has been shown and described for use with a guitar 32 or 70, those skilled in the art will recognize that either device 10 or 10' may alternatively be used in its capacity as a strap locking device, pick storage device, or both, with a variety of other stringed instruments, portable accessories and/or other attachment/mounting structures. Examples of such other stringed instruments, portable accessories and/or other attachment/mounting structures may include, but are not limited to, banjos, mandolins, ukuleles, accordions, portable keyboards, portable cameras, portable video equipment, key rings, jewelry, clothing, and the like. As another example, those skilled in the art will recognize that any of the devices 10, 10', 10", 80 or 100 of the present invention may be easily modified to extend the lengths of the opposing arms to thereby locate the pick receiving channels farther away from the ring or washer structure than what is shown in the drawings. Such modifications would be well within the knowledge of a skilled artisan, wherein the resulting device may be useful with an acoustic guitar or other thick-bodied instrument to extend the location of the one or more picks stored therein beyond the face or top of the instrument for easy access. As a further example, any of the devices 10, 10', 10", 80 or 100 of the present invention may alternatively be modified to store other structures therein including, but not limited to, coins, name plates, jewelry and the like. Such modifications may require reconfiguration of the general shapes of the arms and/or channels defined therein to thereby accommodate such other structures stored therebetween, although such modifications would be well within the knowledge of a skilled artisan and are accordingly intended to fall within the scope of the present invention.

What is claimed is:

1. A pick storage device, comprising:

a first arm defining a free end and an opposite end;

a second arm defining a free end and an opposite end; and a ring connecting said opposite end of said first arm to said opposite end of said second arm, said first and second arms defining opposing channels therein extending from said free ends thereof toward said ring, said channels sized for receiving opposite edges of a plurality of musical instrument picks therein for storage between said first and second arms.

2. The pick storage device of claim 1 where said first arm is biased toward said second arm.

3. The pick storage device of claim 2 further including a plurality of musical instrument picks disposed within said channels and positioned between said first and second arms, said plurality of musical instrument picks urging said first and second arms slightly away from each other.

4. The pick storage device of claim 1 wherein said ring is sized to receive a shaft portion of a musical instrument strap attachment peg therein.

5. The pick storage device of claim 4 wherein said ring defines an inner ring cross-sectional area, said ring configured to expand said inner ring cross-sectional area when said first and second arms are biased toward each other.

6. The pick storage device of claim 5 wherein said musical instrument attachment peg includes a head sized larger than said shaft portion, said ring configured to expand said inner ring cross-sectional area larger than a cross-sectional area of said head of said peg to thereby receive said head therethrough when said first and second arms are sufficiently biased toward each other.

7. The device of claim 1 wherein said ring defines an inner ring surface sized to receive a shaft portion of a musical instrument strap attachment peg therein, said inner ring surface rotatably positionable about said shaft portion to thereby position said first and second arms at a desired location relative to said musical instrument strap.

8. A pick storage device, comprising:

a first arm defining a free end, an opposite end and a first inner arm surface therebetween defining therein a first channel extending from said free end toward said opposite end thereof;

a second arm defining a free end, an opposite end and a second inner arm surface therebetween defining therein a second channel extending from said free end toward said opposite end thereof; and means for connecting said opposite end of said first arm to said opposite end of said second arm;

wherein at least a portion of said first inner arm surface defines a first lobe adjacent said free end of said first arm and extending inwardly toward said second inner arm surface;

and wherein at least a portion of said second inner arm surface defines a second lobe adjacent said free end of said second arm and extending inwardly toward said first inner arm surface.

9. The device of claim 8 wherein said first channel defines first and second opposing sides;

and wherein said first lobe defines at least a portion of one of said first and second opposing sides of said first channel.

10. The device of claim 9 wherein said second channel defines first and second opposing sides;

and wherein said second lobe defines at least a portion of one of said first and second opposing sides of said second channel.

11. The device of claim 10 wherein said first lobe extends along said first inner surface from said free end of said first arm toward said opposite end of said first arm;

and wherein said second lobe extends along said second inner surface from said free end of said second arm toward said opposite end of said second arm.

12. The device of claim 8 wherein said first and second channels are sized to receive at least one musical instrument pick therein for storage between said first and second arms.

13. A pick storage device, comprising:

a first arm having a free end, an opposite end and a first inner arm surface therebetween;

a second arm having a free end, an opposite end and a second inner arm surface therebetween, said first and second arms configured to store at least one musical instrument pick therebetween; and a washer member connecting said opposite end of said first arm to said opposite end of said second arm with said first inner arm surface facing said second inner arm surface, said washer member defining a first opening therethrough.

14. The device of claim 13 further comprising a strap locking device including a strap locking member and a securing member, said first opening sized to receive a shaft portion of said strap locking member therethrough, said shaft portion of said strap locking member sized to extend through a musical instrument strap, said securing member configured to secure said strap locking device with said washer member of said pick storage device mounted thereon to said strap.

15. The device of claim 13 wherein said washer member is configured generally flat along an axis normal to a central axis defined through said first opening.

16. The device of claim 13 wherein said first arm defines a first channel extending along an inner surface of said first arm from said free end toward said opposite end thereof;

and wherein said second arm defines a second channel extending along an inner surface of said second arm from said free end toward said opposite end thereof, said first and second channels configured to receive opposite edges of said at least one musical instrument pick therein.

17. The device of claim 16 wherein said washer member defines a second opening therethrough between said opposite ends of said first and second arms, said second opening providing for movement of said first and second arms toward and away from each other.

18. The device of claim 17 wherein said first and second arms are biased toward each other;

and wherein said first and second arms are urged slightly away from each other when said at least one musical instrument pick is received within said first and second channels.

19. The device of claim 17 wherein at least a portion of said inner arm surface of said first arm defines a first lobe adjacent said free end thereof and extending inwardly toward said inner arm surface of said second arm;

and wherein at least a portion of said inner arm surface of said second arm defines a second lobe adjacent said free end thereof and extending inwardly toward said inner arm surface of said first arm.

20. The device of claim 19 wherein each of said first and second channels define first and second opposing sides;

and wherein said first lobe defines at least a portion of one of said first and second opposing sides of said first channel;

and wherein said second lobe defines at least a portion of one of said first and second opposing sides of said second channel.

21. A pick storage device, comprising:

a first arm defining a free end and an opposite end;

a second arm defining a free end and an opposite end;

means for connecting said opposite end of said first arm to said opposite end of said second arm, said first and second arms defining therein opposing channels sized for receiving therein opposite edges of at least one musical instrument pick for storage between said first and second arms; and a musical instrument strap defining at least one device attachment structure along a portion of said musical instrument strap between first and second ends thereof, said at least one device attachment structure engaging said connecting means and supporting said pick storage device.

22. The device of claim 21 wherein said musical instrument strap defines a plurality of device attachment structures along a portion of said musical instrument strap between said first and second ends thereof, at least one of said device attachment structures engaging said connecting means and supporting said pick storage device.

23. The device of claim 21 wherein said at least one device attachment structure includes a head portion mounted to said strap, said head portion defining a front side and a back side, said connecting means engaging said head portion between said back side thereof and said strap.

24. The device of claim 23 wherein said at least one device attachment structure defines a shaft portion between said back side thereof and said strap, said connecting means engaging said shaft portion.

25. The device of claim 24 wherein said shaft portion and said connecting means is configured to engage at least a portion of a periphery of said shaft portion, said pick storage device rotatably positionable about said shaft portion.

26. The device of claim 21 wherein said at least one device attachment structure includes at least one flexible strand, said connecting means engaging said at least one flexible strand and supporting said pick storage device.

27. The device of claim 21 wherein said at least one device attachment structure includes a rigid member defining a bore therethrough, said connecting means disposed through said bore and engaging said rigid member.

* * * * *